US007356931B2

(12) United States Patent
Lai

(10) Patent No.: US 7,356,931 B2
(45) Date of Patent: Apr. 15, 2008

(54) HAIRDRESSING SCISSORS

(76) Inventor: Hui-Chuan Lai, No. 139, Kuangchun Road, Chaochou Township, Pingtung County (TW) 92043

( * ) Notice: Subject to any disclaimer, the term of this patent is extended or adjusted under 35 U.S.C. 154(b) by 77 days.

(21) Appl. No.: 11/388,341

(22) Filed: Mar. 23, 2006

(65) Prior Publication Data

US 2006/0213065 A1 Sep. 28, 2006

(51) Int. Cl.
*B26B 13/00* (2006.01)

(52) U.S. Cl. ..... 30/226; 30/227; 30/254

(58) Field of Classification Search ..... 30/226, 30/227, 254, 145–147, 195–197, 229; D8/57, D8/93

See application file for complete search history.

(56) References Cited

U.S. PATENT DOCUMENTS

| | | | | |
|---|---|---|---|---|
| D427,497 | S * | 7/2000 | Yeh | D8/57 |
| 6,192,590 | B1 | 2/2001 | Yeh | |
| 6,557,263 | B1 | 5/2003 | Yeh | |
| 6,634,106 | B2 * | 10/2003 | Yeh | 30/226 |
| 6,748,662 | B2 * | 6/2004 | Yeh | 30/226 |
| 6,990,739 | B2 * | 1/2006 | Yeh | 30/226 |
| 7,194,808 | B2 * | 3/2007 | Yeh | 30/226 |
| 7,207,112 | B2 * | 4/2007 | Yeh | 30/226 |
| 7,207,113 | B2 * | 4/2007 | Yeh | 30/226 |
| 2004/0078982 | A1 * | 4/2004 | Yeh | 30/226 |
| 2006/0150425 | A1 * | 7/2006 | Yeh | 30/226 |
| 2006/0272160 | A1 * | 12/2006 | Yeh | 30/226 |
| 2007/0044319 | A1 * | 3/2007 | Yeh | 30/194 |

FOREIGN PATENT DOCUMENTS

| | | | |
|---|---|---|---|
| JP | 2001259258 | A * | 9/2001 |
| JP | 2003169975 | A * | 6/2003 |
| JP | 2004357855 | A * | 12/2004 |

* cited by examiner

*Primary Examiner*—Terrence R. Till
*Assistant Examiner*—Joseph Defrank
(74) *Attorney, Agent, or Firm*—Pro-Techtor Int'l Services

(57) ABSTRACT

A pair of hairdressing scissors, wherein a connecting block is mounted in the hairdressing scissor, on a first wall surface of the connecting block is protrusively formed a rib portion having a retaining ear thereof, and on a second wall surface of the connecting block is defined with a perforation thereof for engaging with the retaining ear, and an elastic member is mounted in the connecting block. Therefore, when the retaining ear of one pair of hairdressing scissors is engaged in the perforation of another pair of hairdressing scissors, the elastic member presses against the retaining ear, in this way, the pairs of hairdressing scissors can be coupled and positioned relative to one another firmly.

6 Claims, 10 Drawing Sheets

HAIRDRESSING SCISSORS

BACKGROUND OF THE INVENTION

1. Field of the Invention

The present invention relates to a pair of hairdressing scissors, and more particularly to a pair of hairdressing scissors that can be coupled and positioned relative to one another firmly.

2. Description of the Prior Art

Referring to FIG. 1, a perspective view of a pair of hairdressing scissors of U.S. Pat. Nos. 6,192,590 and 6,557,263, wherein each handle 11 and 12 of a pair of hairdressing scissors 1 is formed with each through hole 111 and 121. A connecting block 13 is securely mounted in the through holes 111 and 121, in the wall of a side of the connecting block 13 is defined with a hollow groove 131 as shown in FIG. 2, and the surface of a side of the connecting block 13 is defined with a hole 132, and the surface of the other side of the connecting block 13 is protrusively formed with an engaging section 133 for engaging in the hole 132. In this way, engaging the hole 132 of the connecting block 13 of one pair of hairdressing scissors with the engaging section 133 of the connecting block 13 of another pair of hairdressing scissors, the pair of hairdressing scissors 1 are coupled and positioned relative to one another, and plural pairs of hairdressing scissors 1 can be positioned relative to one another in the same way.

Due to the above-mentioned device, plural pairs of hairdressing scissors 1 can be positioned relative to one another, so that the user can hold the plural pairs of hairdressing scissors 1 with one hand easily, and the pair of hairdressing scissors 1 can be opened and closed simultaneously. However, such device mainly comprises the pair of hairdressing scissors 1, wherein the hole 132 of the connecting block 13 of one pair of hairdressing scissors is engaged with the engaging section 133 of the connecting block 13 of another pair of hairdressing scissors, and after a long period of using, the coupled connecting blocks 13 will loosen because of friction. Therefore, the coupled pairs of hairdressing scissors 1 can be shaken, thus affecting the operation of the user and the beauty of the hairstyle.

The present invention has arisen to mitigate and/or obviate the afore-described disadvantages.

SUMMARY OF THE INVENTION

The primary objective of the present invention is to provide a pair of hairdressing scissors that can be coupled and positioned relative to one another firmly. A connecting block is securely mounted in the hairdressing scissor, on the surface of a outer side of the connecting block is protrusively formed a rib portion having a retaining ear, and on the surface of the other outer side of the connecting block is defined with a perforation which can be inserted with the retaining ear, and an elastic member is mounted in the connecting block, so that when two pairs of hairdressing scissors are coupled, and the retaining ear of one pair of hairdressing scissors is engaged in the perforation of another pair of hairdressing scissors, the elastic member presses against the retaining ear, in this way, the pairs of hairdressing scissors can be coupled and positioned relative to one another firmly.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
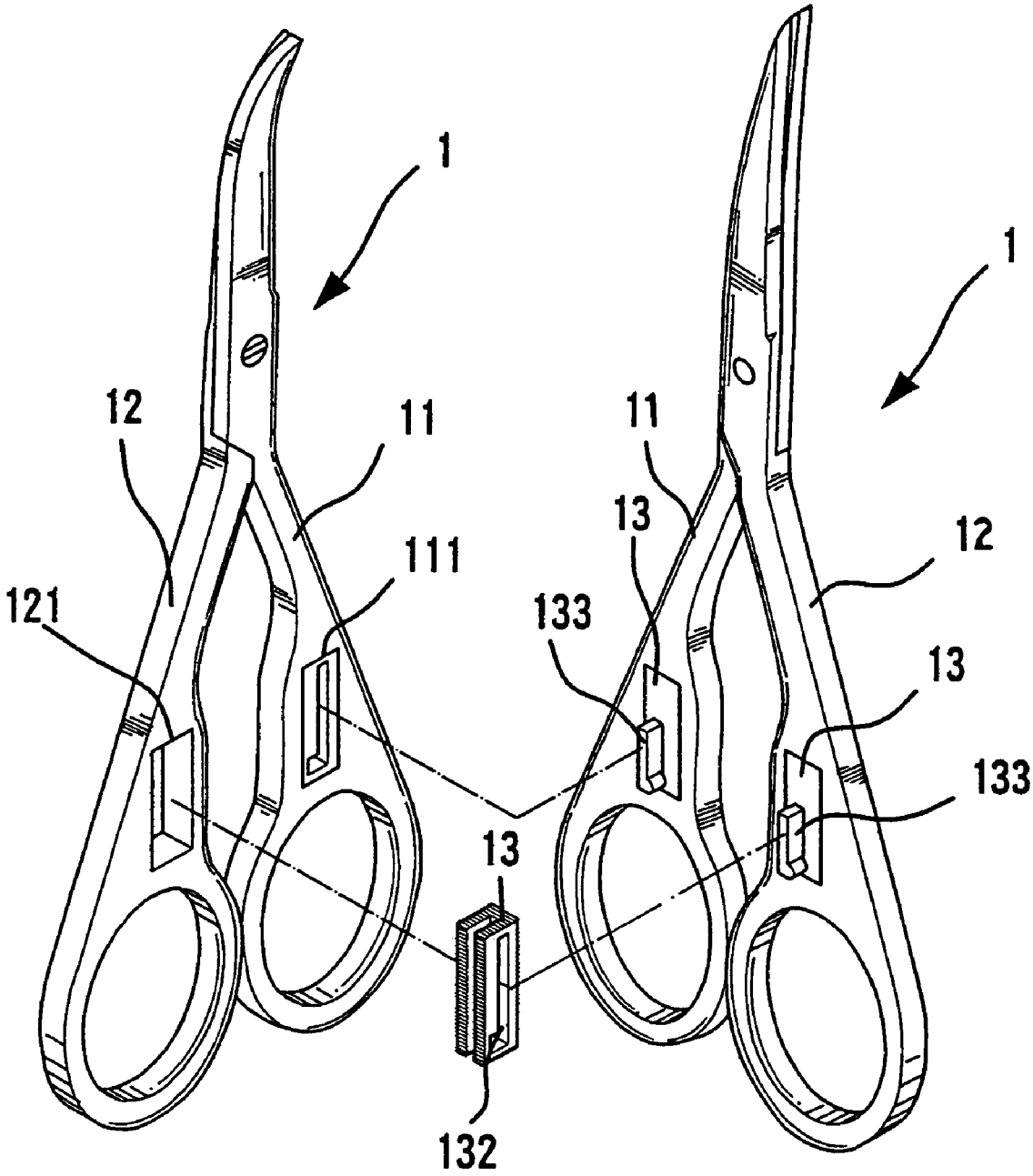
FIG. 1(Prior Art)
FIG. 1 is a perspective view of a pair of hairdressing scissors of U.S. Pat. Nos. 6,192,590 and 6,557,263.
Figure 2:
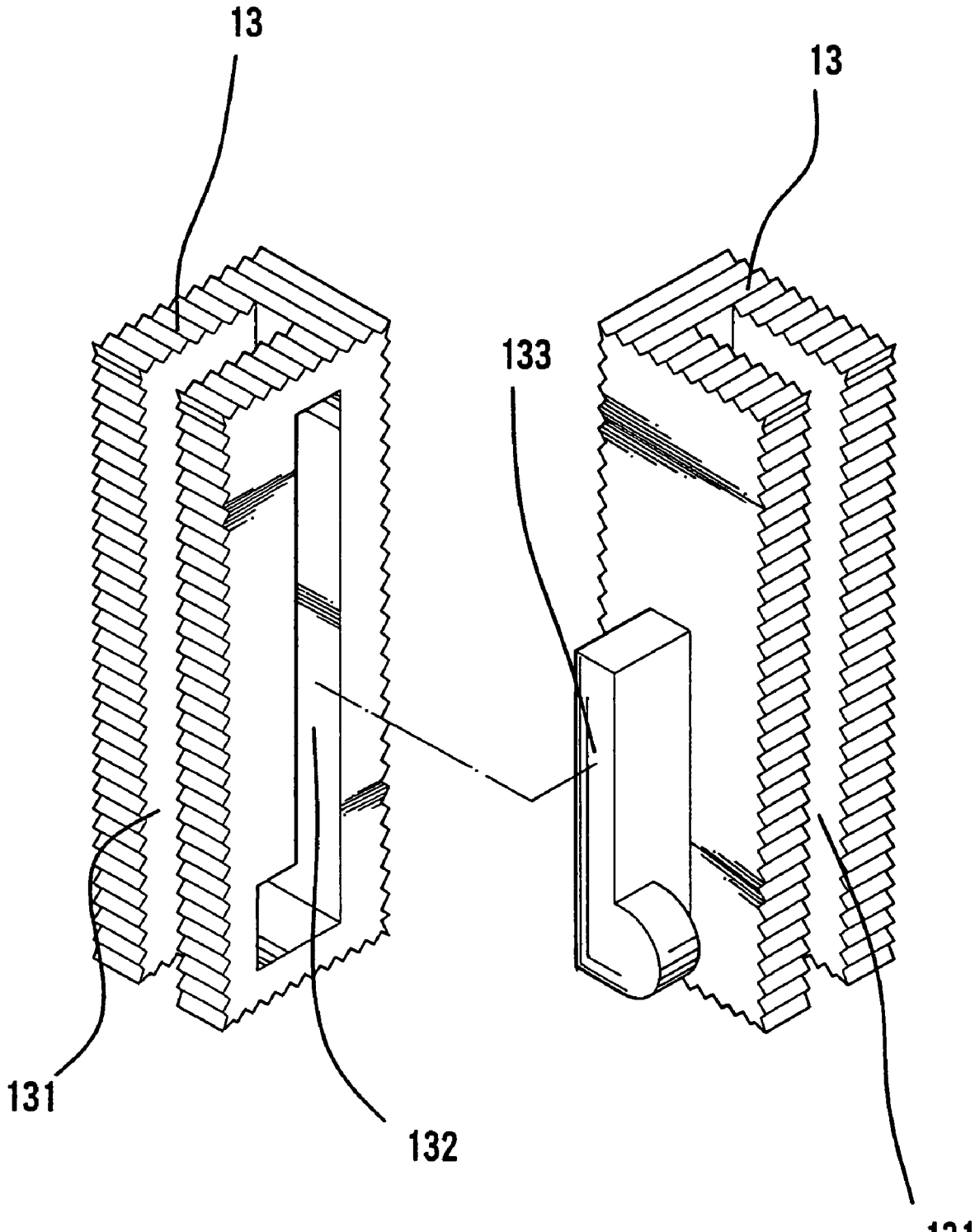
FIG. 2(Prior Art)
FIG. 2 is an exploded view of two connecting blocks of FIG. 1.
Figure 3:
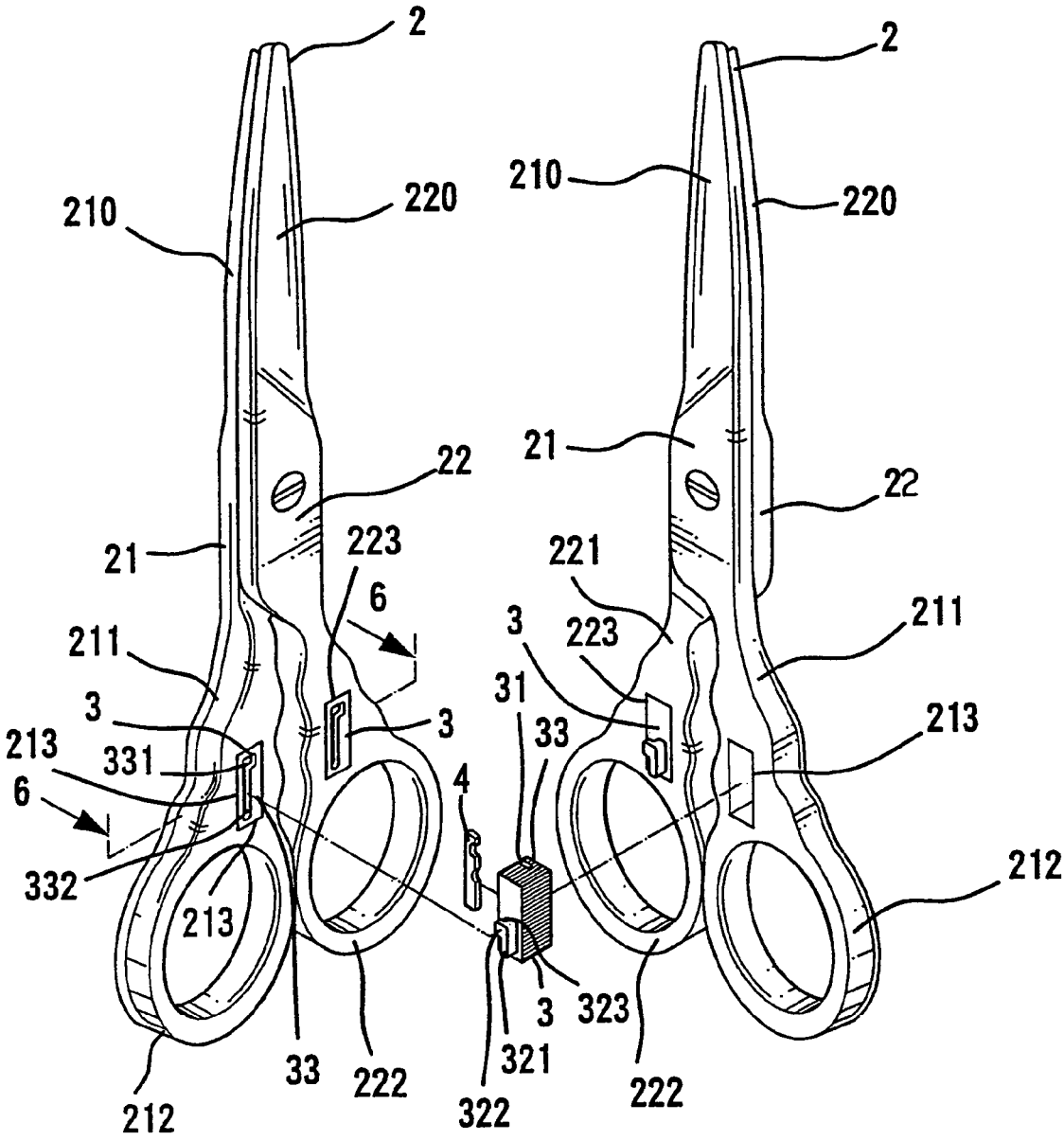
FIG. 3 is an exploded view of a pair of hairdressing scissors in accordance with the present invention.

Referring to FIG. 3, wherein a first cutting member 21 and a second cutting member 22 of a pair of hairdressing scissors 2 in accordance with the present invention are pivotally connected to each other. The first cutting member 21 comprises a blade 210 on an end thereof and a handle 211 on the other end thereof. The second cutting member 22 comprises a blade 220 on an end thereof and a handle 221 on the other end thereof, and the end of each handle 211, 221 has an annular portion opening 212, 222 for the fingers of the user. At least one of the cutting members 21 or/and 22 defined with a through hole 213 and 223 thereof.

Figure 5:
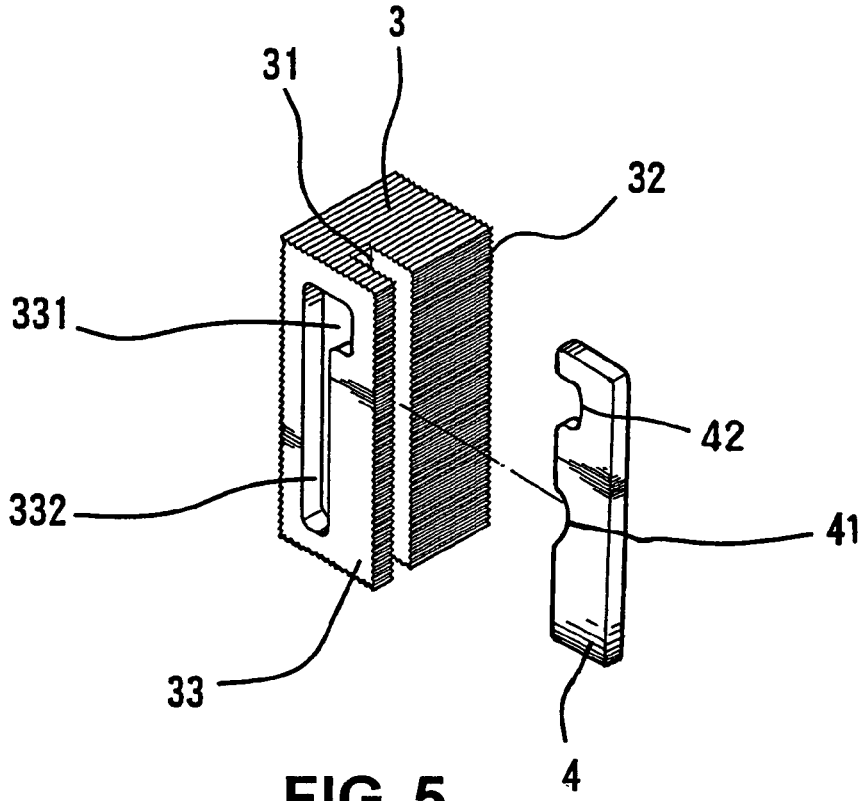
FIG. 5 is a perspective view of the connecting block and the elastic member of FIG. 4 rotating for 90 degrees in an anticlockwise direction, of showing the groove and a second wall surface of the connecting block.
Figure 4:
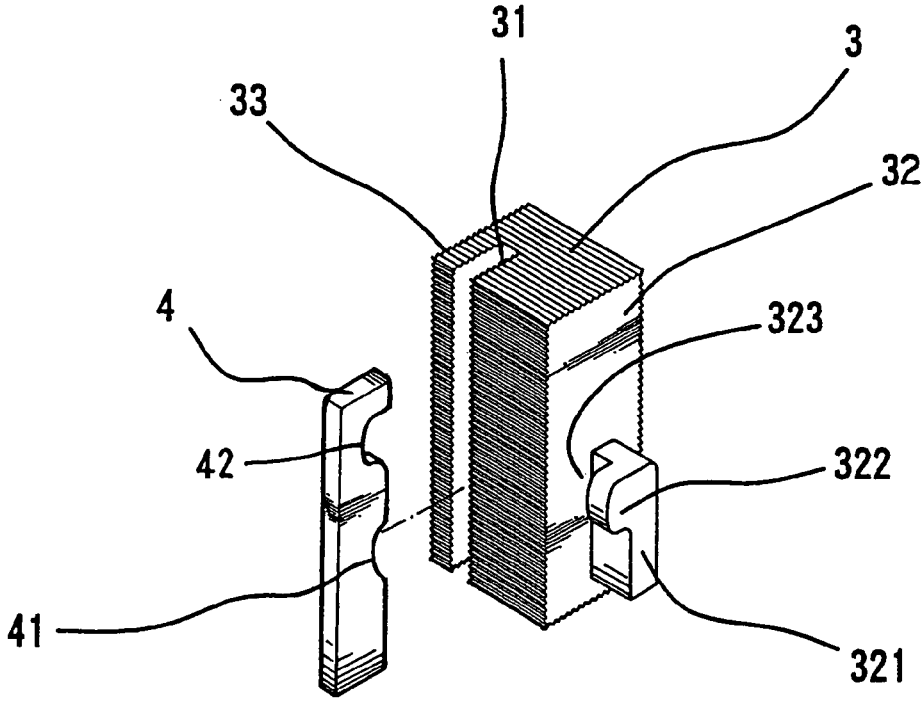
FIG. 4 is a perspective view of a connecting block and an elastic member of FIG. 3 rotating for 90 degrees in an anticlockwise direction, of showing a groove and a first wall surface of the connecting block.

A connecting block 3 is securely mounted in the through holes 213, 223 of the cutting members 21, 22 of the pair of hairdressing scissors 2, the connecting block 3 has a groove 31 formed between the two sides thereof and a first wall surface 32 and a second wall surface 33. As Shown in FIG. 4, a rib portion 321 is protrusively formed on the first wall surface 32 of the connecting block 3, a retaining ear 322 is vertically extended from the rib portion 321, and the width of a gap 323 formed between the retaining ear 322 and the first wall surface 32 is similar to the thickness that formed between the second wall surface 33 and the groove 31. As shown in FIG. 5, a perforation 331 is defined on the second wall surface 33 of the connecting block 3, which is opposite to the retaining ear 322, the perforation 331 is extended to form a groove hole 332, the width of the groove hole 332 is similar to the thickness of the rib portion 321, and the perforation 331, the groove hole 332 and the groove 31 are connected to one another.

Figure 6:
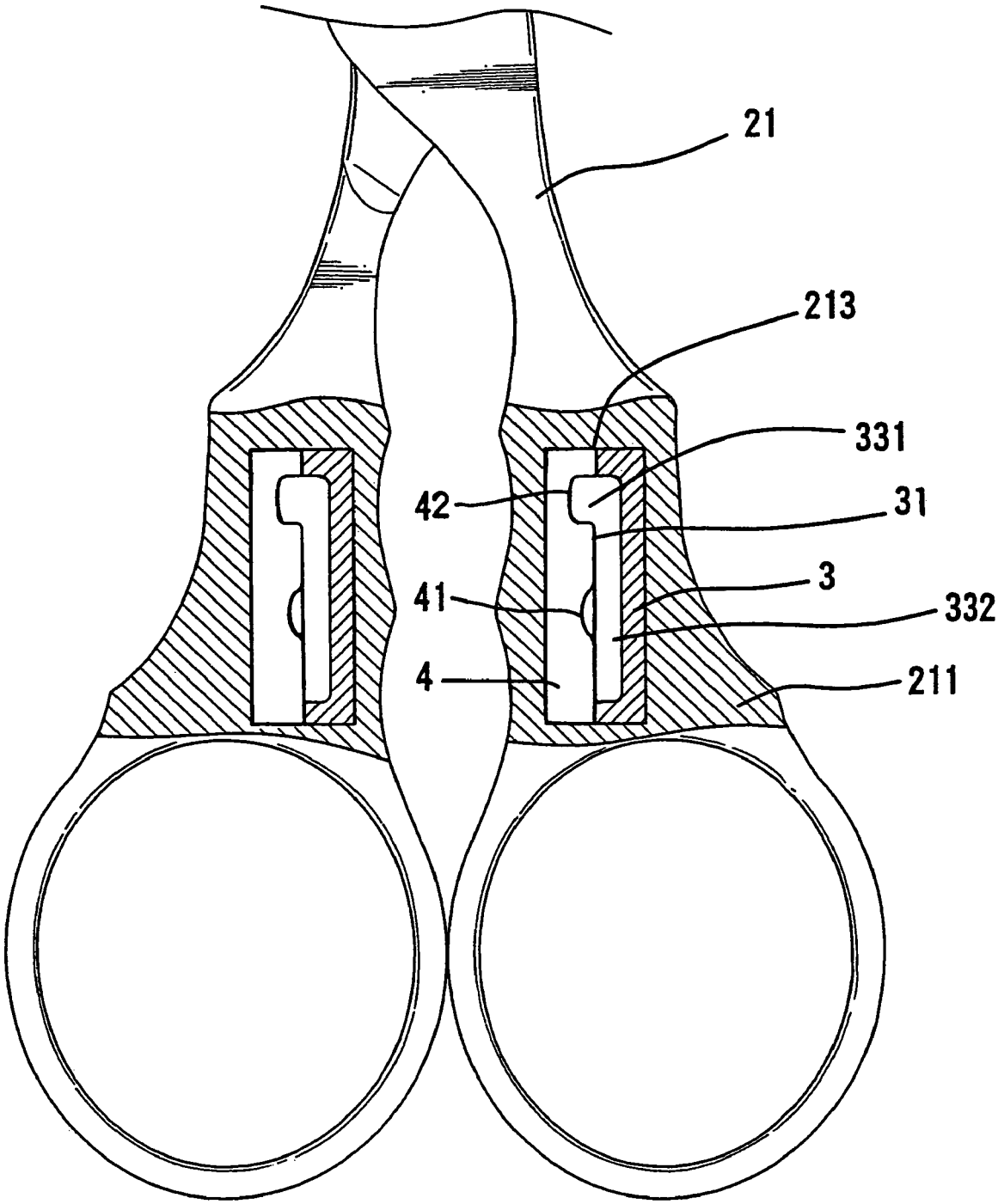
FIG. 6 is a cross sectional view of FIG. 3 taken along the line 6-6.

Referring to FIG. 6, an elastic member 4 is mounted in the groove 31 of the connecting block 3 and pressed against the through holes 213 for positioning, the elastic member 4 is disposed with an engaging concave 41 opposite to the groove hole 332 of the connecting block 3. A retaining concave 42B is provided for retaining the retaining ear 322A of the connecting block 3A as shown in FIG. 7.

Figure 7:
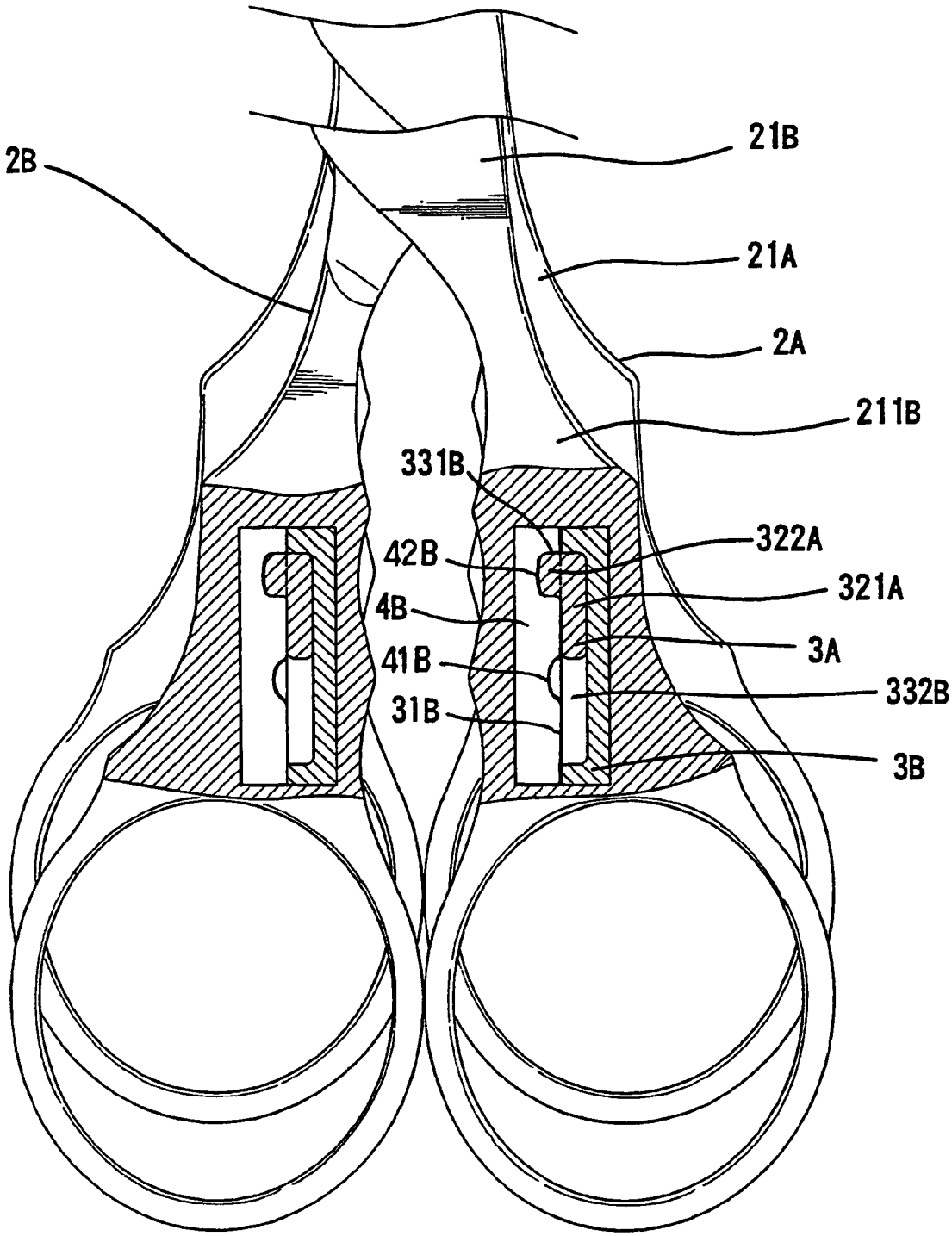
FIG. 7 is a cross sectional view of the coupled hairdressing scissors in accordance with the present invention.
Figure 8:
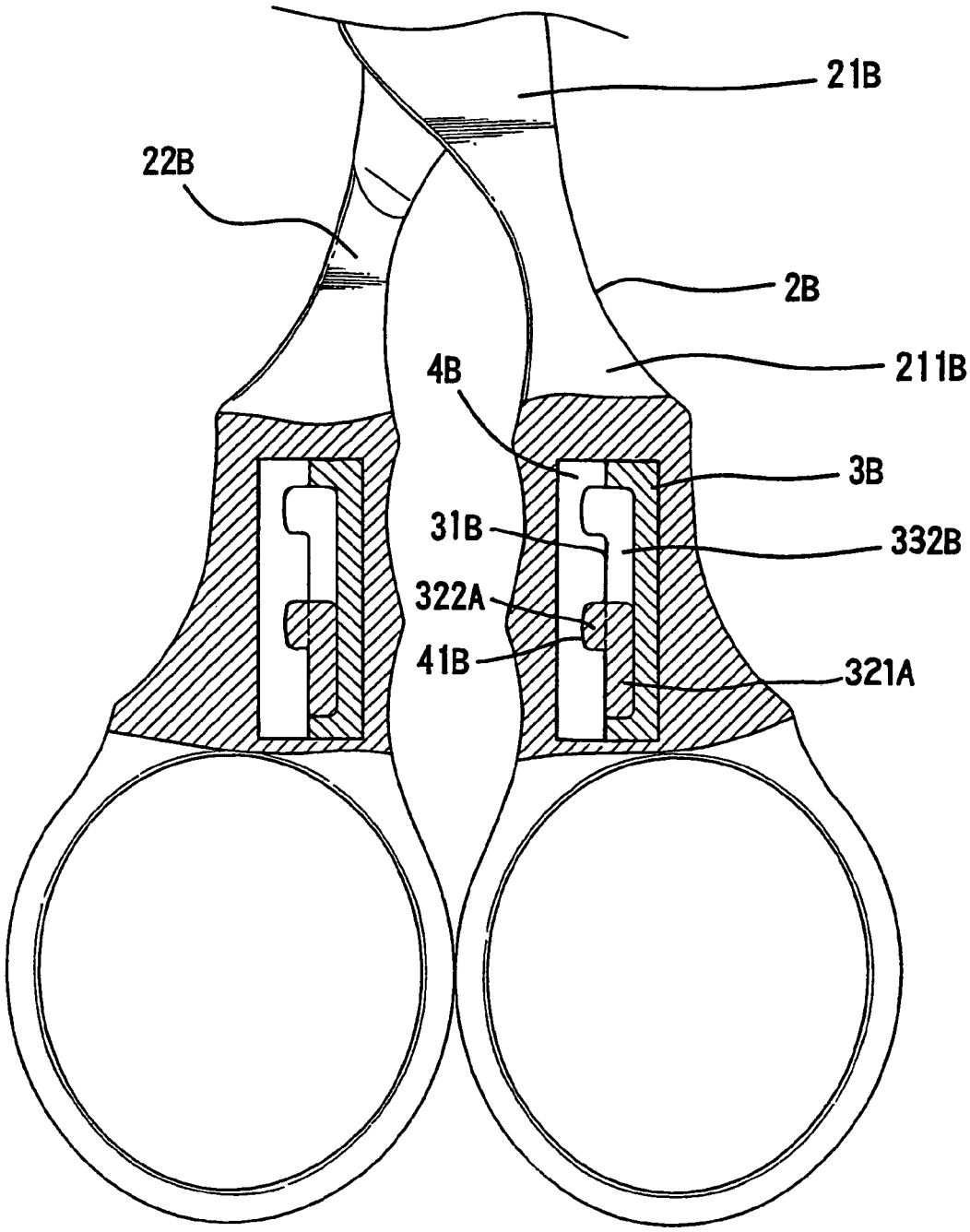
FIG. 8 is an operational view of FIG. 7.
Figure 9:
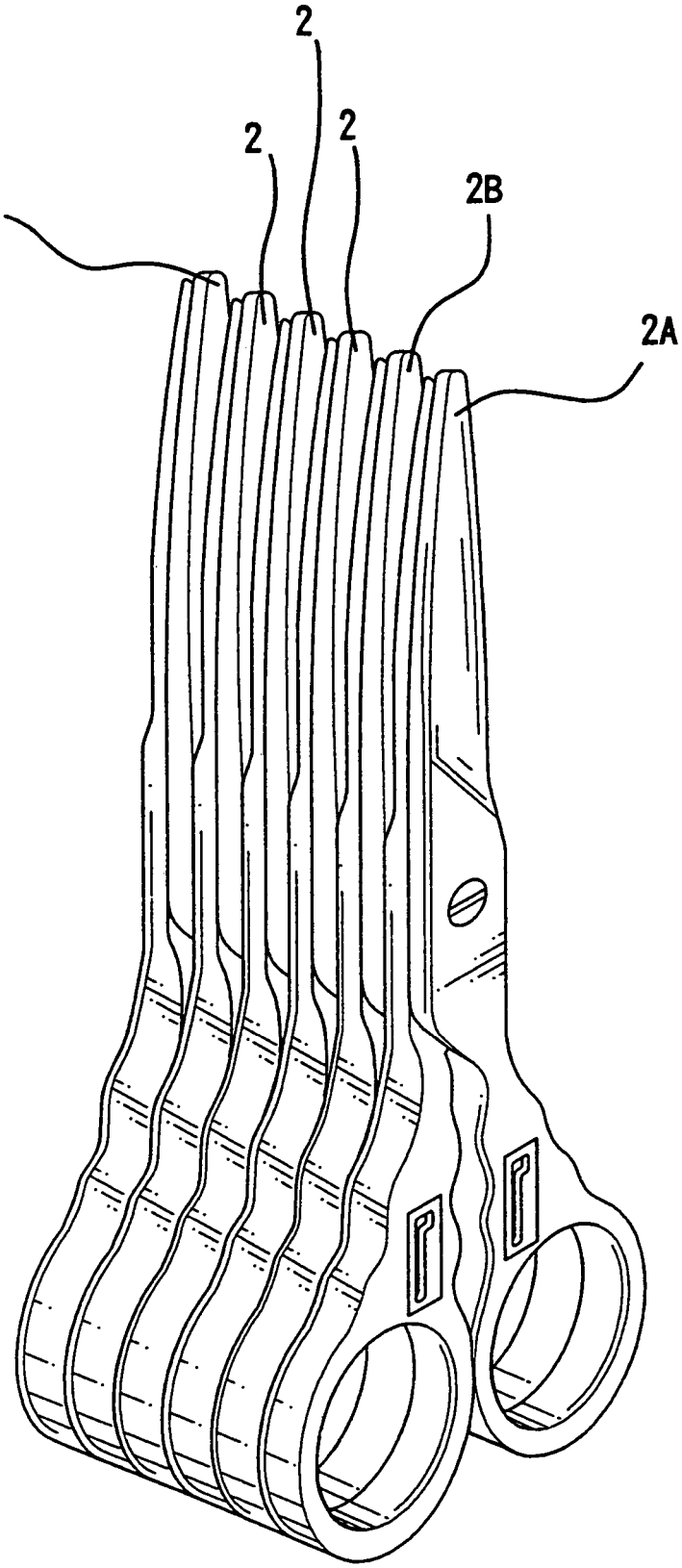
FIG. 9 is a perspective view of plural pairs of hairdressing scissors that coupled relative to one another.

Referring to FIG. 7 and FIG. 8, when engaging one pair of hairdressing scissors 2A with another pair of hairdressing scissors 2B, a first wall surface 32A of a connecting block 3A of the pair of hairdressing scissors 2A is opposite to a second wall surface 33B of the connecting block 3B of the pair of hairdressing scissors 2B, so that a retaining ear 322A of the connecting block 3A is inserted into a perforation 331B of the connecting block 3B so as to retain in a retaining concave 42B of an elastic member 4B of the pair of hairdressing scissors 2B. Furthermore, as shown in FIG. 8, in order to make the pair of hairdressing scissors 2A moved opposite to the pair of hairdressing scissors 2B, a rib portion 321A of the pair of hairdressing scissors 2A is slide between a groove hole 332B and the groove 31B of the pair of hairdressing scissors 2B, and make the retaining ear 322A of the pair hairdressing scissors 2A slide in the groove 31B of the connecting block 38 of the pair hairdressing scissors 2B so as to couple the pair of hairdressing scissors 2A with the pair hairdressing scissors 2B as shown in FIG. 9. As for the operation of the elastic member of the present invention, when the retaining ear 322A of the pair of hairdressing scissors 2A is engaged in the groove 31B of the connecting block 3B of the pair of hairdressing scissors 2B, an engaging concave 41B of an elastic member 4B of the pair of hairdressing scissors 2B is provided for positioning the retaining ear 322A as shown in FIG. 8. By such arrangement, when the distance between the coupled connecting blocks is too longer, the pair of hairdressing scissors can be positioned stably by the elastic member.

In addition, when the elastic member 4 is disposed with more than one engaging concave 41, plural pairs of hairdressing scissors can be positioned and connected with one another in different height section.

Figure 10:
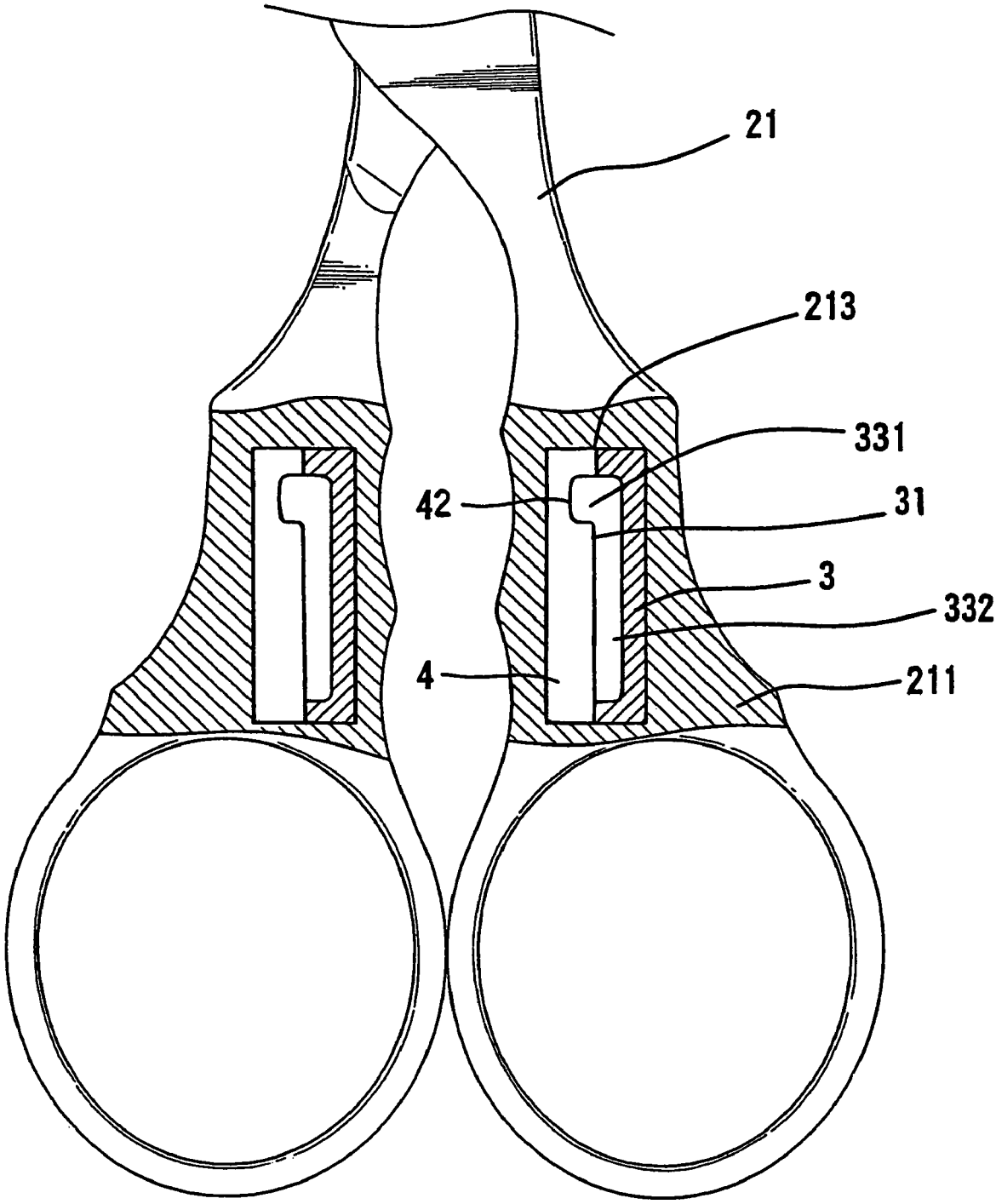
FIG. 10 is a cross sectional view of a hairdressing scissor in accordance with another embodiment of the present invention.
Figure 11:
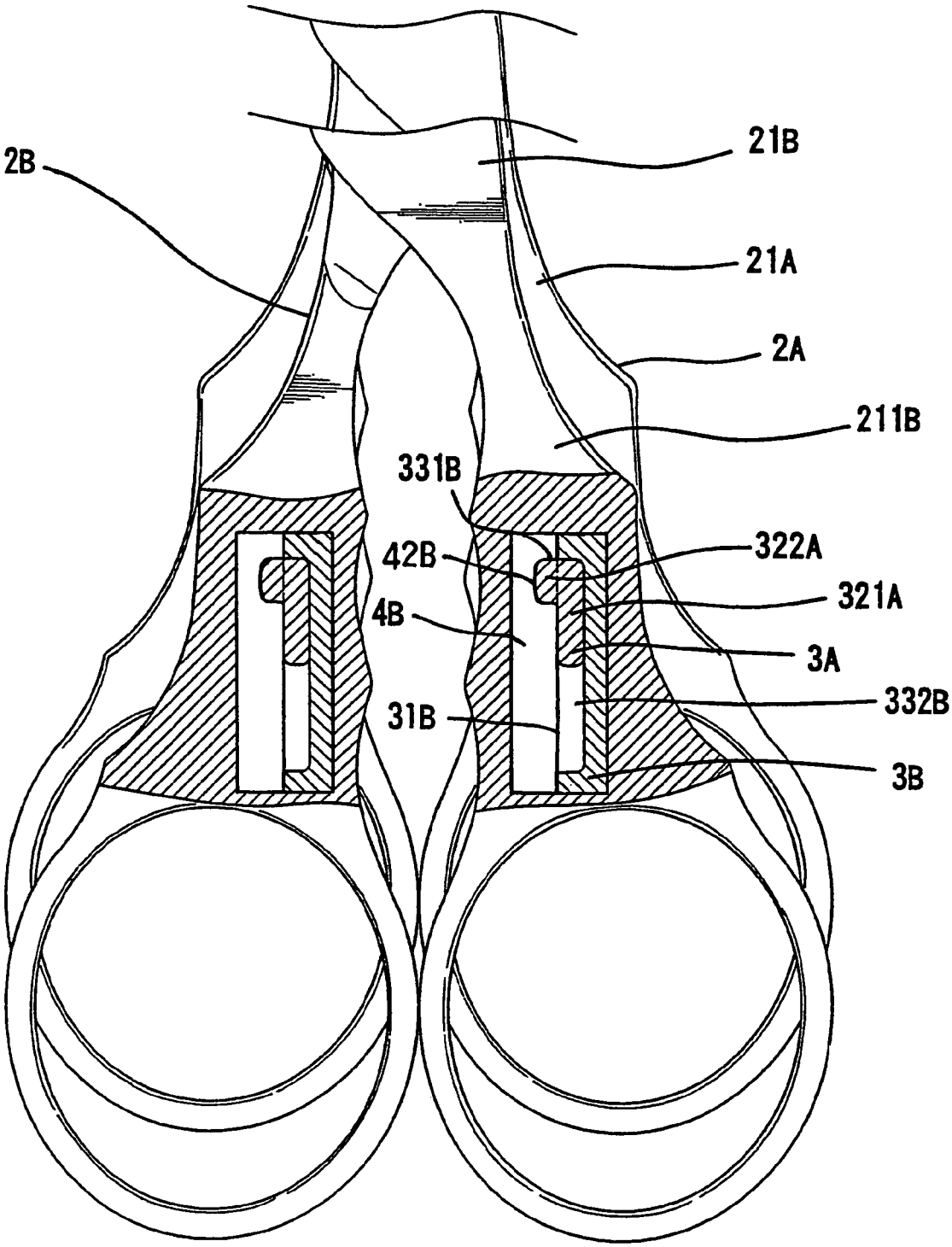
FIG. 11 is another cross sectional view of two pairs of hairdressing scissors that coupled together of FIG. 10.

Referring to FIG. 10 and FIG. 11, another embodiment in accordance with the present invention is shown, wherein the elastic member 4 is not disposed with the engaging concave 41, when the pairs of hairdressing scissors 2A and 2B are coupled together, the retaining ear 322A of the pair of hairdressing scissors 2A is slide in the groove 31B of the connecting block 3B of the pair of hairdressing scissors 2B, the elastic member 4B of the pair of hairdressing scissors 2B abuts against the retaining ear 322A for positioning the pair of hairdressing scissors 2A to a predetermined position.

The above-mentioned elastic member 4 can be made of silicon, rubber, plastic or other elastic materials.

While we have shown and described various embodiments in accordance with the present invention, it should be clear to those skilled in the art that further embodiments may be made without departing from the scope of the present invention.

What is claimed is:

1. A pair of hairdressing scissors, comprising:

two cutting members pivotally connected to each other;

a connecting block, which connected with at least one of the two cutting members, and defined with a first wall surface and a second wall surface, the first wall surface being mounted with a rib portion having a retaining ear in a top edge thereof, the second wall surface is defined with a perforation opposite to the retaining ear, and the perforation being extended to form a groove hole; and an elastic member, disposed in the connecting block, when a pair of hairdressing scissors is coupled with another one, the retaining ear of one pair of hairdressing scissors being engaged in the perforation of another pair of hairdressing scissors, the rib portion of one pair of hairdressing scissors being slide in the groove hole of another pair of hairdressing scissors, and the retaining ear of one pair of hairdressing scissors abutting against the elastic member of another pair of hairdressing scissors;

wherein the pair of hairdressing scissors further comprises a groove defined in the connecting block for retaining the elastic member.

2. The pair of hairdressing scissors as claimed in claim 1, wherein the pair of hairdressing scissors still comprises at least an engaging concave defined in the elastic member thereof for engaging the retaining ear of the connecting block.

3. The pair of hairdressing scissors as claimed in claim 1, wherein the pair of hairdressing scissors still comprises a retaining concave defined in the elastic member thereof for engaging the retaining ear of the connecting block.

4. The pair of hairdressing scissors as claimed in claim 1, wherein the pair of hairdressing scissors further comprises a through hole defined at least one of the cutting members for connecting to the connecting block.

5. The pair of hairdressing scissors as claimed in claim 1, wherein the perforation and the groove hole of the connecting block are connected to the groove.

6. The pair of hairdressing scissors as claimed in claim 1, wherein the elastic member is made of silicon.

* * * * *